US005276967A

United States Patent [19]

Ferraro et al.

[11] Patent Number: 5,276,967

[45] Date of Patent: Jan. 11, 1994

[54] FLEXIBLE RAZOR UNIT EMPLOYING CORRUGATED SPACER

[75] Inventors: Frank A. Ferraro, Trumbull; Vincent C. Motta, Norwalk, both of Conn.

[73] Assignee: Warner-Lambert Company, Morris Plains, N.J.

[21] Appl. No.: 54,583

[22] Filed: Apr. 29, 1993

[51] Int. Cl.[5] ..... A26B 21/00

[52] U.S. Cl. ..... 30/49; 30/32; 30/41; 30/50

[58] Field of Search ..... 30/32, 41, 49, 50, 84, 30/90

[56] References Cited

U.S. PATENT DOCUMENTS

| | | | |
|---|---|---|---|
| 3,890,704 | 6/1975 | Ferraro | 30/50 |
| 4,854,043 | 8/1989 | Chen | 30/49 |
| 4,976,028 | 12/1990 | Chen | 30/49 |
| 5,003,694 | 4/1991 | Chen | 30/49 |

*Primary Examiner*—Douglas D. Watts
*Assistant Examiner*—Paul M. Heyrana, Sr.
*Attorney, Agent, or Firm*—Charles W. Almer

[57] ABSTRACT

A flexible, twin-blade razor unit employing a corrugated spacer for providing improved cutting effectiveness. The corrugations increase the rigidity of the blades, which, in turn, decreases the amplitude of any vibration introduced into the blades.

6 Claims, 3 Drawing Sheets

FLEXIBLE RAZOR UNIT EMPLOYING CORRUGATED SPACER

BACKGROUND OF THE INVENTION

The present invention relates to a flexible, twin-blade razor unit and, more particularly, to a flexible, twin-blade razor unit employing a corrugated spacer for providing improved cutting effectiveness.

Today, the use of flexible wet-shaving razor units, such as disposable razors and cartridges, has become quite common. These flexible razor units, such as the ones disclosed in commonly-owned U.S. Pat. No. 4,854,043 and U.S. patent application Ser. No. 07/563,926 filed on Aug. 7, 1990, represent a significant advance in the shaving field. In particular, the flexible razor unit flexes in response to forces encountered during shaving, thereby enabling the razor unit to conform to the natural contour of the surface being shaved. In turn, this brings a greater portion of the blade(s) into effective, cutting contact with the surface being shaved.

With the advent of flexible, twin-blade razor units, additional design challenges have been brought to light. For example, it has become necessary to focus on the rigidity of the blades. More specifically, unlike the prior art units in which the blades could be rigidly fixed to the housing of the unit, the blades in a flexible razor must be allowed some degree of freedom. As will be apparent to those skilled in the art, without such freedom the blades would prevent, or at the least limit, the razor unit from flexing.

However, designing the razor unit so that the blades may move relative to one another hinders the ability of the designer to provide a razor unit in which the blades are rigidly fixed to the housing. This rigidity is important to the blades of a wet shaving razor unit in that blade rigidity decreases the amplitude of any vibration introduced into the blade during shaving. Ideally, the amplitude of this vibration should be maintained as low as possible to ensure that the razor unit is providing the user with a comfortable and close shave.

It would therefore be desirable to provide a flexible, wet-shaving razor unit in which the blades are afforded a degree of freedom to allow flexing, yet, at the same time, are provided with increased rigidity that, in turn, provides improved cutting effectiveness.

SUMMARY OF THE INVENTION

The present invention, which addresses the needs of the prior art, provides a flexible, twin-blade wet-shaving razor unit having improved cutting effectiveness. The razor unit includes both a cap blade and a seat blade, each of the blades having a cutting edge for shaving. The razor unit also includes a seat portion and a cap portion between which the blades of the razor unit are exposed. Finally, the razor unit includes a spacer disposed between the blades. The spacer includes corrugations for increasing the rigidity of the cutting edge during shaving.

In a preferred embodiment, the spacer includes a plurality of corrugations interconnected by a plurality of plates. The plates extend substantially across the width of the seat blade and, preferably, are fixedly connected to the blade. Moreover, the corrugations of the spacer support and extend substantially across the width of the cap blade.

In another preferred embodiment, each of the blades has a substantially equal portion of unsupported material, thereby ensuring that the blades begin to vibrate simultaneously when subjected to an external force.

Accordingly, the present invention provides a flexible, twin-blade razor unit that affords the blades sufficient freedom to allow flexing of the razor unit yet, at the same time, provides blades having increased rigidity that improve the cutting effectiveness of the unit.

DETAILED DESCRIPTION OF THE INVENTION

Figure 1:
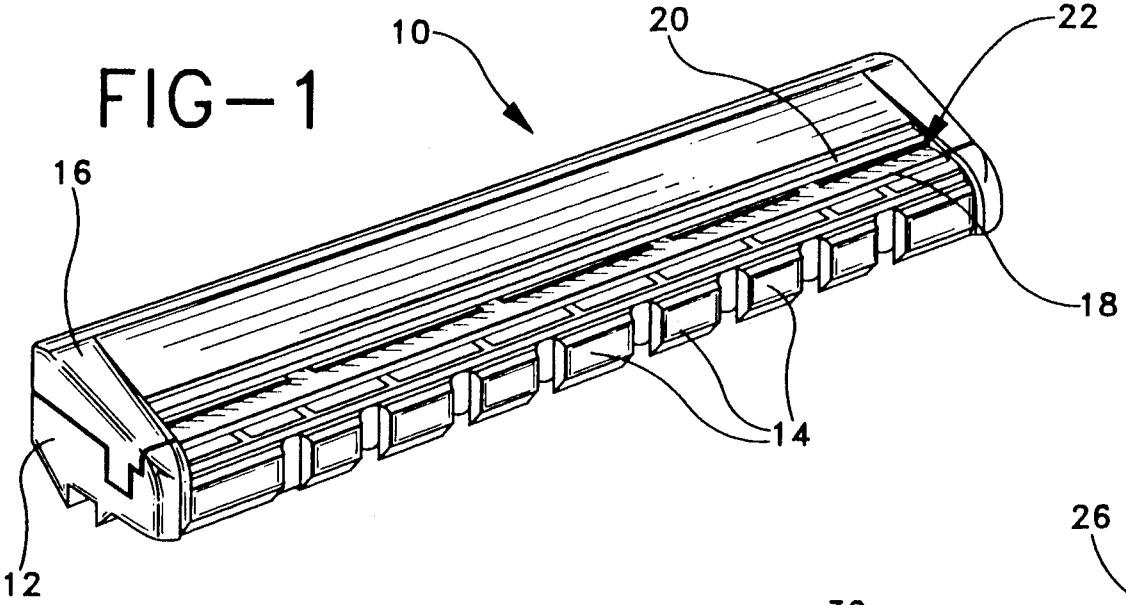
FIG. 1 is a perspective view of a flexible, twin-blade wet-shaving razor unit.

Referring to the drawings and, in particular, to FIG. 1, a flexible, twin-blade wet-shaving razor unit 10 is shown. Razor unit 10 includes a seat portion 12 having a guard bar 14, a cap portion 16, a seat blade 18 and a cap blade 20. Disposed between the blades is a corrugated spacer 22.

Figure 2:
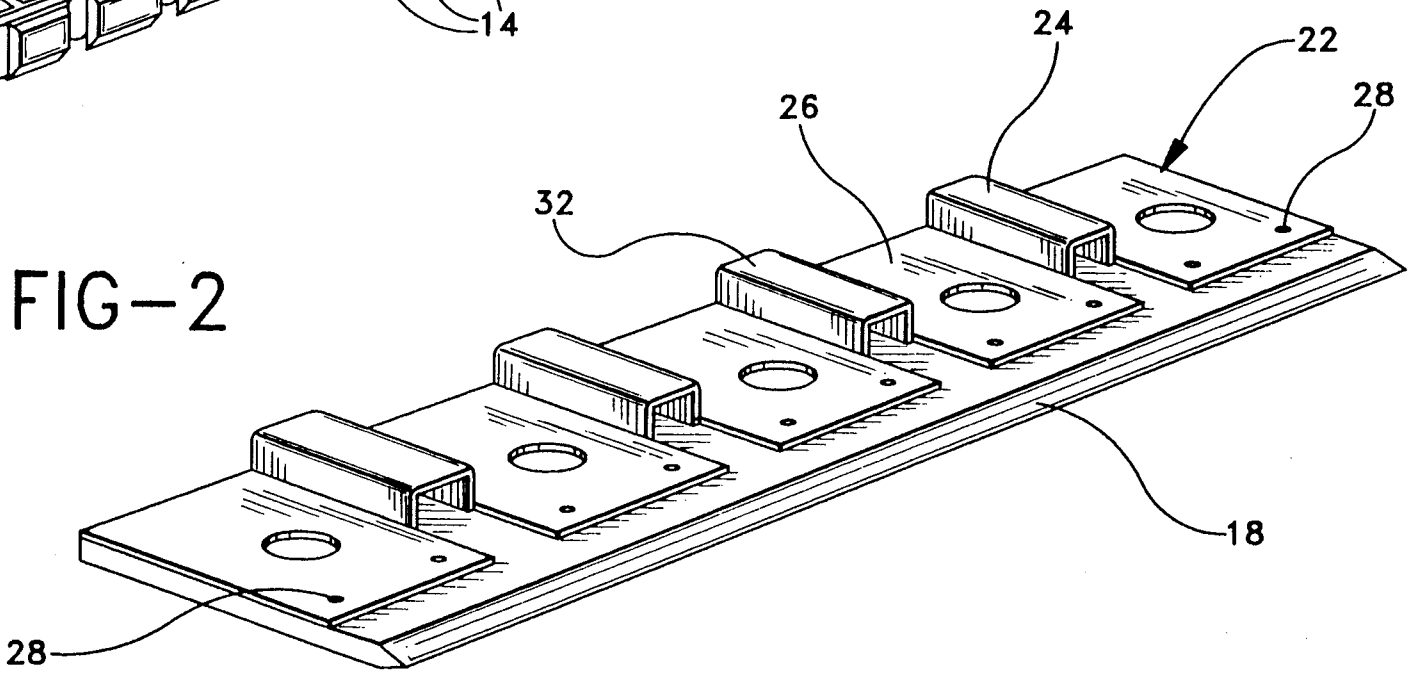
FIG. 2 is a perspective view of the corrugated spacer employed in the present invention.

As best shown in FIG. 2, spacer 22 extends along the entire length L of seat blade 18. Spacer 22 includes a plurality of corrugations 24, which increase the flexibility of the spacer, interconnected by a plurality of plates 26. plates 26 extend across a substantial portion of the width W of seat blade 18.

As will be apparent to those skilled in the art, the design and configuration of spacer 22 will increase the rigidity of the blades, while, at the same time, still allowing such blades to flex in response to forces encountered during shaving. In this regard, a preferred embodiment of the present invention may provide that the plates are fixedly connected to the seat blades by means of spot welds 28. Fixedly connecting the spacer to the blade ensures that the alignment of such components remains constant and, in addition, further increases the rigidity of the blade. However, it is not necessary to fixedly connect the spacer to the seat blade; instead, as explained below, merely sandwiching the uniquely designed components together can provide the desired increase in rigidity of the blade.

Figure 3:
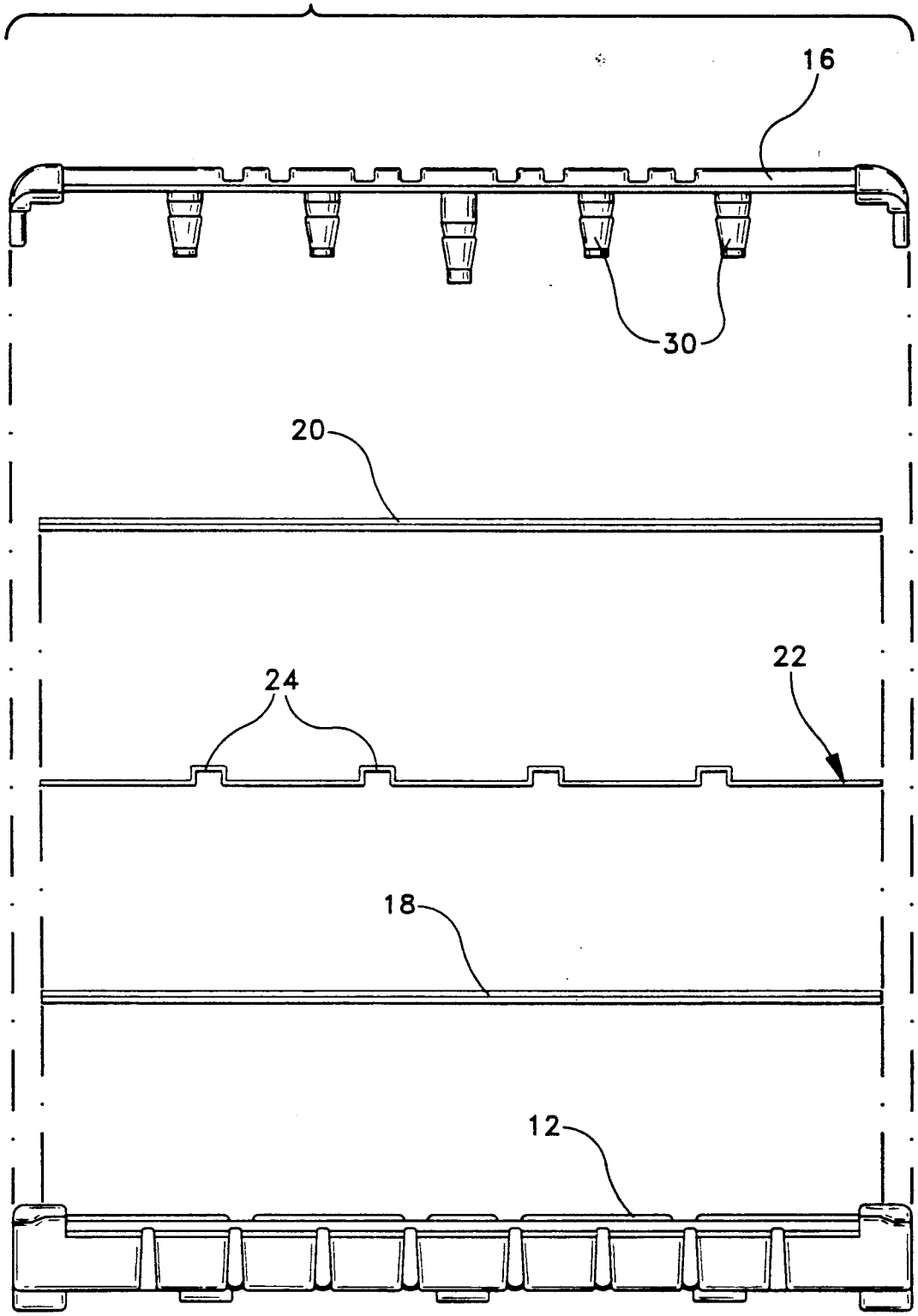
FIG. 3 is an exploded, elevational view of the components of the present invention.
Figure 4:
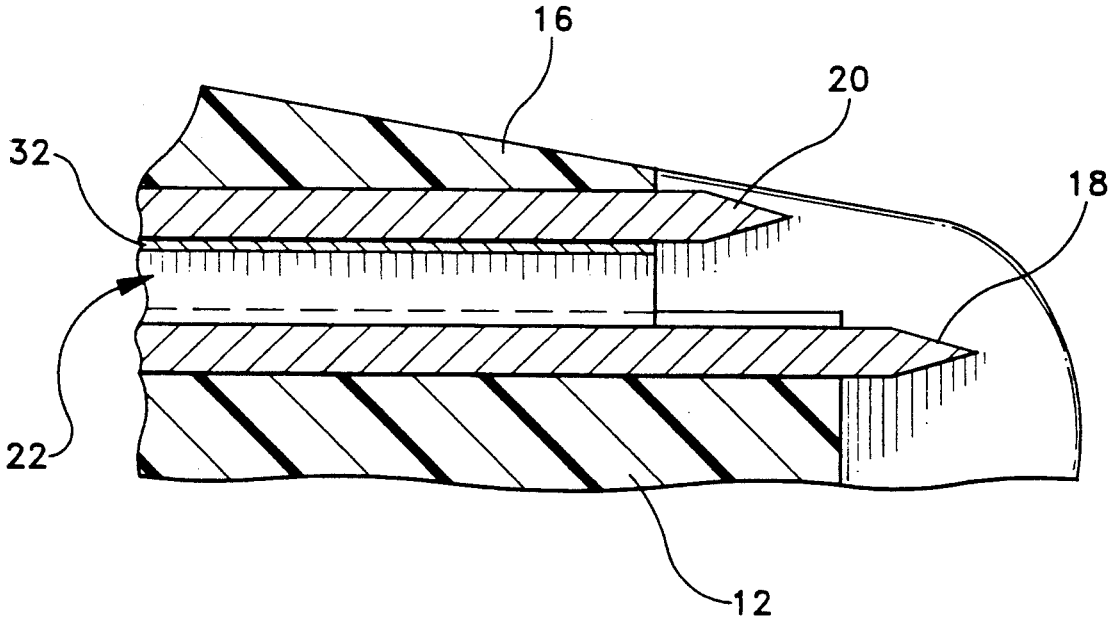
FIG. 4 is a cross-sectional view taken along lines 4—4 of FIG. 1.

Referring to FIG. 3, it can be seen that cap blade 20, spacer 22 and seat blade 18 are sandwiched between cap portion 16 and seat portion 12. More specifically, cap portion 16 includes a plurality of securing pins 30 that pass through a series of co-linear openings in the cap blade, spacer and seat blade. The securing pins are received by openings in seat portion 12 that are dimensioned so that pins 30 can be "snapped" in and, thereafter, not withdrawn. In addition, the pins are dimensioned so that once the unit is assembled, the components of such units are tightly sandwiched between the cap and seat portion. To allow relative movement of the blades during flexing, the openings in these components (except for the centrally-positioned openings) may be formed in the configuration of a slot. With respect to the spacer, the openings (except for the centrally-positioned opening) are formed with a diameter slightly larger than the diameter of the securing pins. Together, the design allows the components to slide pass one another as the razor unit is flexed.

When the razor unit is assembled, upper surface 32 of corrugations 24 will contact and, hence, support the lower surface of cap blade 20. The support these corrugations provide to the cap blade translates into increased rigidity of such blade. In addition, it is possible to configure the components of the razor unit such that both the cap blade and the seat blade are equally supported.

Finally, as already mentioned above, the corrugated spacer provides increased rigidity to the blades, which, in turn, decreases the amplitude of vibration introduced into such blade.

While there have been described what are presently believed to be the preferred embodiments of the invention, those skilled in the art will realize that various changes and modifications may be made to the invention without departing from the spirit of the invention and it is intended to claim all such changes and modifications as fall within the scope of the invention.

What is claimed is:

1. A flexible, twin-blade wet shaving razor unit providing improved cutting effectiveness comprising:

a cap blade and a seat blade, each of said blades having a cutting edge for shaving;

a seat portion and a cap portion, said blades disposed and secured for shaving between said seat and cap portions; and a spacer disposed between said blades, said spacer including corrugations for increasing the rigidity of said cutting edge during shaving, wherein said corrugations are interconnected by a plurality of plates, said plates maintaining surface contact with said seat blade during flexing incurred while shaving and wherein said plates are attached to said seat blade.

2. The razor unit according to claim 1, wherein said corrugations serve to space said cap blade from said seat blade while maintaining surface contact with said cap blade during flexing incurred while shaving.

3. The razor unit according to claim 1, wherein each of said corrugations has a channel-shaped cross section.

4. The razor unit according to claim 1, wherein said plates extend substantially across the width of said seat blade.

5. The razor unit according to claim 4, wherein said plates are welded to said seat blade at a position proximate said cutting edge.

6. The razor unit according to claim 1, wherein said corrugations extend substantially across the width of said cap blade.

* * * * *